United States Patent [19]

Nankervis

[11] Patent Number: 4,507,835

[45] Date of Patent: Apr. 2, 1985

[54] ADJUSTABLE PRESS JIG FOR FRONT WHEEL STRUT ASSEMBLY

[76] Inventor: Robert L. Nankervis, 219 Holland Rd., Holmdel, N.J. 07733

[21] Appl. No.: 480,451

[22] Filed: Mar. 30, 1983

Related U.S. Application Data

[63] Continuation-in-part of Ser. No. 306,144, Sep. 28, 1981, abandoned.

[51] Int. Cl.[3] ..... B25B 1/22; B30B 15/06

[52] U.S. Cl. ..... 29/251; 269/50; 269/60; 269/71; 269/104; 269/258; 269/269; 269/296

[58] Field of Search ..... 269/47, 50–53, 269/60, 45, 71, 258, 104, 152, 269, 296; 259/134; 29/281.1, 281.4, 281.5, 251, 252; 100/214, 257

[56] References Cited

U.S. PATENT DOCUMENTS

| | | | |
|---|---|---|---|
| 2,391,187 | 12/1945 | Page | 29/251 |
| 2,440,820 | 5/1948 | Frank | 269/258 |
| 2,709,384 | 5/1955 | Harris | 269/269 |
| 2,814,099 | 11/1957 | Knittel | 269/296 |
| 2,825,477 | 3/1958 | Ross | 269/296 |
| 2,853,771 | 9/1958 | Melville | 269/50 |
| 2,885,165 | 5/1959 | Smolen | 269/47 |
| 2,948,057 | 8/1960 | Dagenais | 29/251 |
| 3,048,387 | 8/1962 | Waggoner | 269/71 |
| 3,306,601 | 2/1967 | Mitchell | 269/50 |
| 3,359,618 | 12/1967 | Murphy | 29/251 |
| 4,003,305 | 1/1977 | King | 29/251 |
| 4,123,038 | 10/1978 | Meyers | 254/134 |
| 4,234,174 | 11/1980 | Cardona | 269/60 |
| 4,307,877 | 12/1981 | Rogos | 269/47 |

*Primary Examiner*—Robert C. Watson

*Attorney, Agent, or Firm*—Harvey B. Jacobson

[57] ABSTRACT

A jig is provided including a base for support from the base plate of a hydraulic press over which a downwardly extendible ram is mounted. The jig includes a pair of upstanding supports spaced horizontally apart and with at least one of the upstanding supports mounted from the base for shifting toward and away from the other upstanding support. A first of the supports includes a mount supported therefrom for angular displacement about a horizontal axis extending transversely of a plane containing the upstanding supports and a provided with mounting shank portion generally paralleling and swingable in the aforementioned plane when the mount is angularly displaced about its axis of oscillation. The second of the upstanding support mounts a cradle assembly therefrom for adjustable positioning vertically therealong and for oscillation about a horizontal axis paralleling the first mentioned axis. The cradle may embracingly engage the strut portion of a horizontally disposed McPherson-type strut assembly including a wheel hub journalling portion at one end provided with a ball joint mounting bore generally paralleling the strut portion. The mounting shank may be secured through the mounting bore and the mount may be angularly positioned in concert with vertical adjustment of the cradle for support of the strut assembly with the wheel hub journalling portion axially aligned with the associated ram.

10 Claims, 5 Drawing Figures

ADJUSTABLE PRESS JIG FOR FRONT WHEEL STRUT ASSEMBLY

CROSS-REFERENCE TO RELATED APPLICATIONS

This application comprises a continuation-in-part of our co-pending U.S. application Ser. No. 306,144, for ADJUSTABLE HUB AND ROTOR SEPARATOR ASSEMBLY FOR FRONT WHEEL DRIVE MOTOR VEHICLES, filed Sept. 28, 1981, now abandoned.

BACKGROUND OF THE INVENTION

McPherson-type strut assemblies supporting the front wheels on front wheel drive assemblies include lower end steering knuckles from which the front wheel hubs and rotors (if provided) are journalled by bearings pressed into bearing seats formed in the steering knuckles. If it becomes necessary to replace the wheel bearings, the hub, or to refinish or replace the rotor, it is necessary to force the bearings from their seats in order to remove the hub. Inasmuch as these bearings are initially pressed into place, their removal can be difficult, especially if the knuckle, bearing and hub assembly have been assembled for sometime.

One method of bearing removal involves the use of a slide-hammer with a bearing adapter fitted thereto, but manual forces exerted by slide-hammers is considered minimal when performing such a bearing removal operation. Accordingly, and especially since McPherson-type strut assemblies may be reasonably quickly removed from an associated vehicle after the vehicle has been jacked up and the wheel has been removed, a more effective way of removing the subject bearings is through the use of a hydraulic or mechanical press. However, because of the unusual physical characteristics of a McPherson-type strut assembly, it is difficult to non-yieldingly support such a strut assembly in proper position for actuation thereon by the ram of a press. Accordingly, a need exists for a strut assembly supporting jig which may be used in conjunction with a press, whether the press is vertically disposed or horizontally disposed.

Examples of various forms of supporting jigs including some of the general structural and operational features of the instant invention are disclosed in U.S. Pat. Nos. 2,440,820, 3,048,387, 3,306,601, 4,123,038 and 4,234,174.

BRIEF DESCRIPTION OF THE INVENTION

The jig of the instant invention includes an elongated base having a plan area for disposition at right angles relative to the extendible ram of a hydraulic or mechanical press and the base includes a pair of elongated supports projecting outwardly from the base in directions generally normal to the plan area of the base. One of the supports is mounted from the base for shifting toward and away from the other support and a first of the supports includes a mount supported from its free end for angular displacement about an axis extending transverse to a plane containing the elongated supports. The mount supports a mounting shank disposed and swingable in the aforementioned plane during angular displacement of the mount relative to the first support and the outer end of the second support mounts a cradle therefrom for angular displacement about an axis generally paralleling the first mentioned axis and with the cradle substantially paralleling the aforementioned plane. The cradle is further supported from the second support for adjustable positioning along a path generally paralleling the second support.

The main object of this invention is to provide a jig for use in conjunction with a hydraulic or mechanical press and constructed in a manner whereby a McPherson-type struts assembly may be supported from the jig with the bearing seats of the knuckle of the strut assembly aligned with the center axis of movement of the press ram or head.

Another object of this invention is to provide a jig in accordance with the preceding objects and including adjustment features adapting the jig for use in conjunction with strut assemblies of different sizes and types.

Another important object of this invention is to provide a jig constructed in a manner whereby the jig may compensate for ball joint mounting bores of strut assemblies which are variously inclined relative to the strut tubes thereof.

A final object of this invention to be specifically enumerated herein is to provide a McPherson-type strut assembly support jig in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout. cl

DETAILED DESCRIPTION OF THE INVENTION

Figure 1:
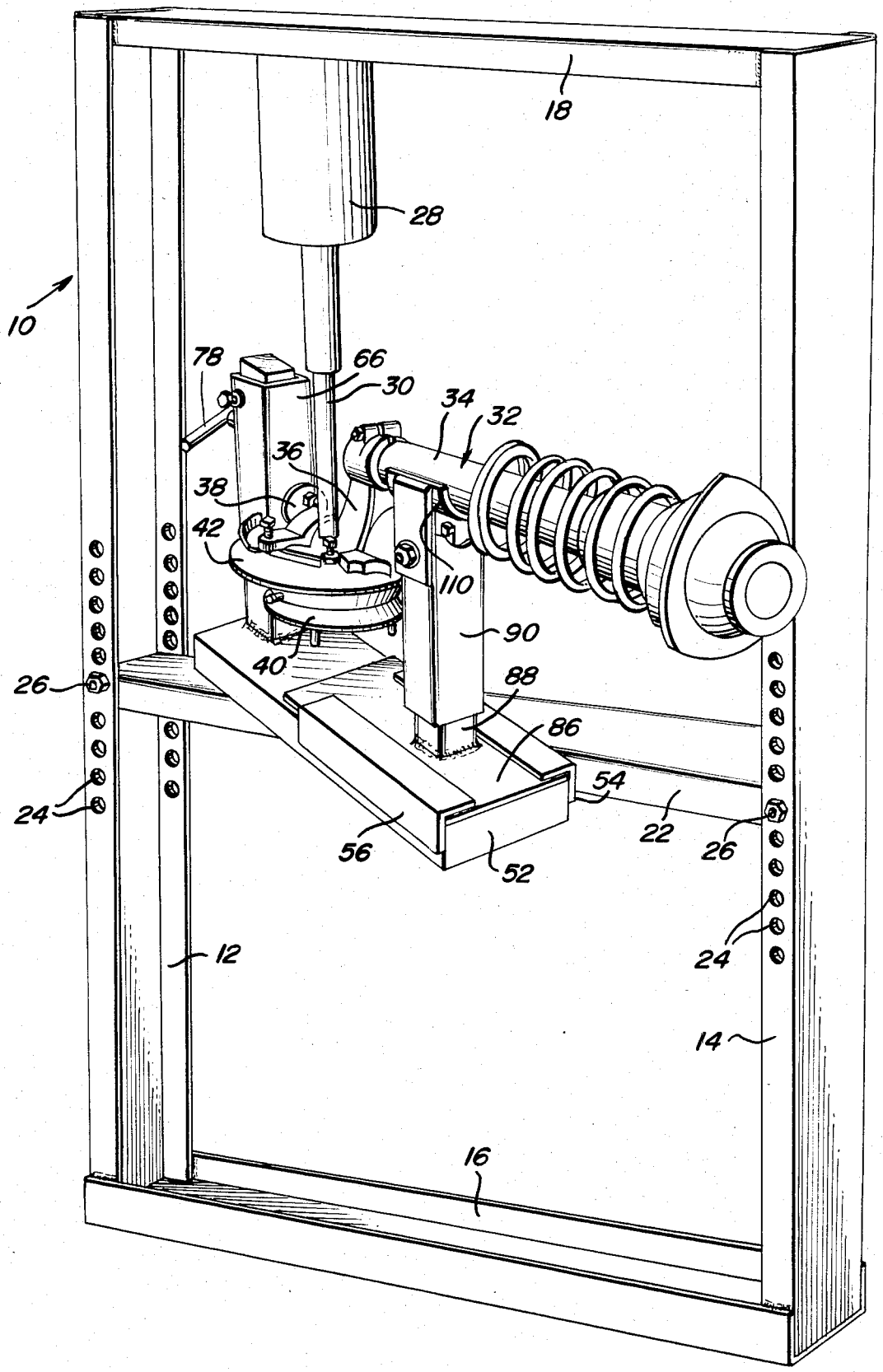
FIG. 1 is a perspective view of a typical form of vertically disposed hydraulic press and with the jig of the instant invention in operative association with the press and supported from the base plate thereof in use mounting a McPherson-type strut assembly from the jig in position for the hub bearings of the strut to be pressed therefrom by the ram of the press.
Figure 2:
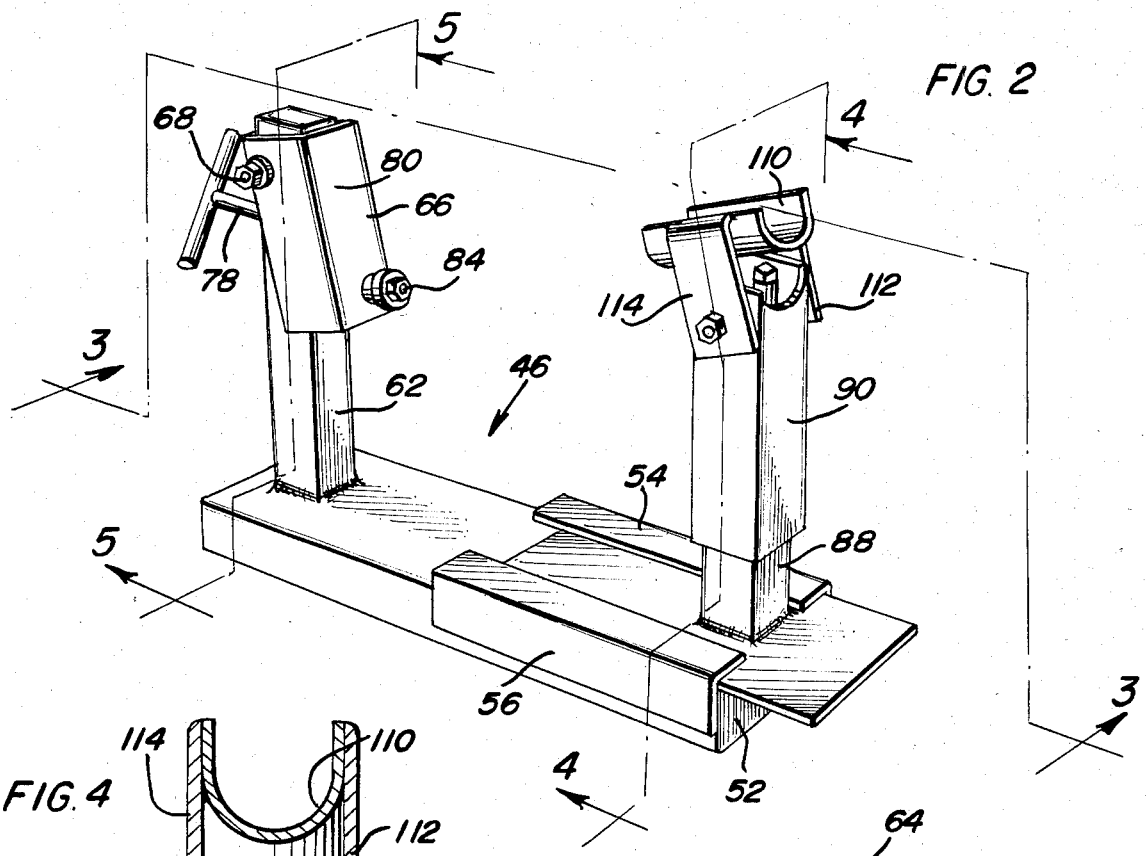
FIG. 2 is a perspective view of the jig.
Figure 4:
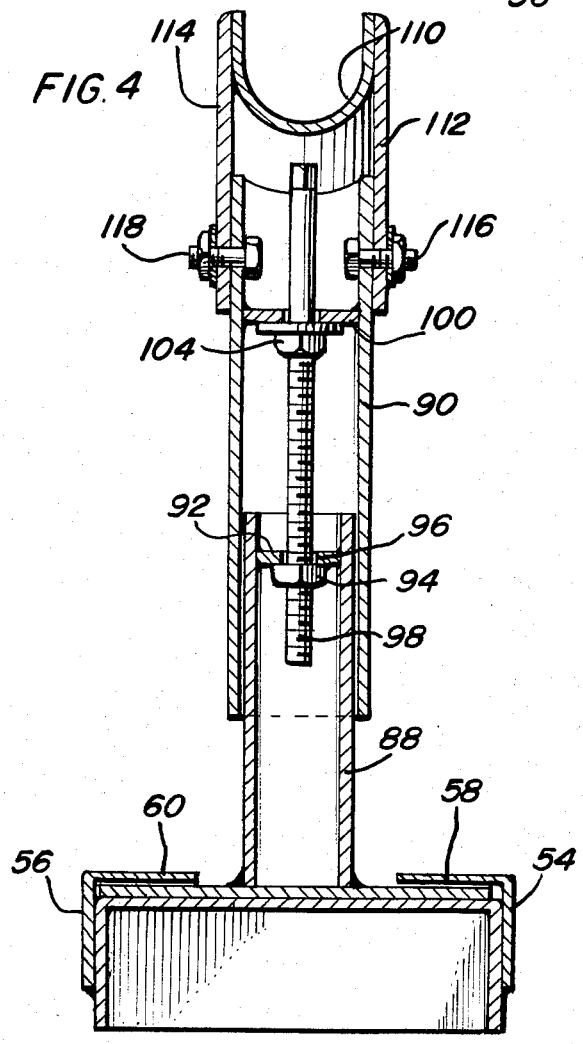
FIG. 4 is an enlarged transverse vertical sectional view taken substantially upon the plane indicated by the section line 4—4 of FIG. 2.
Figure 5:
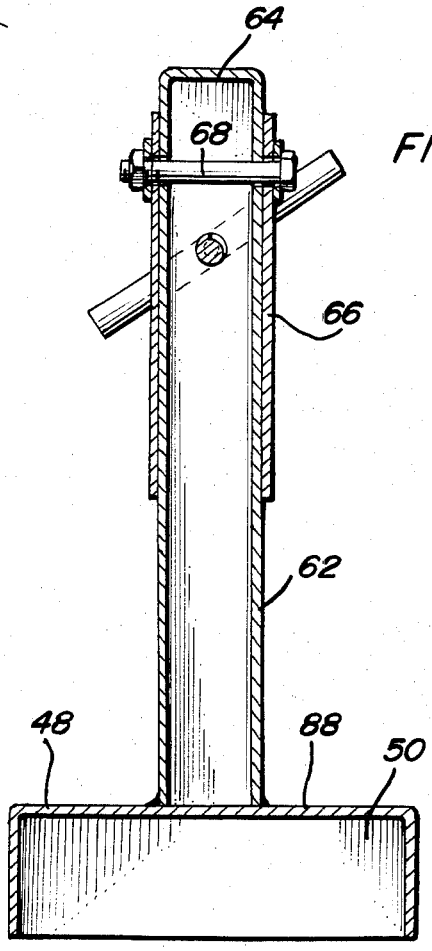
FIG. 5 is a transverse vertical sectional view taken substantially upon the plane indicated by the section line 5—5 of FIG. 2.
Figure 3:
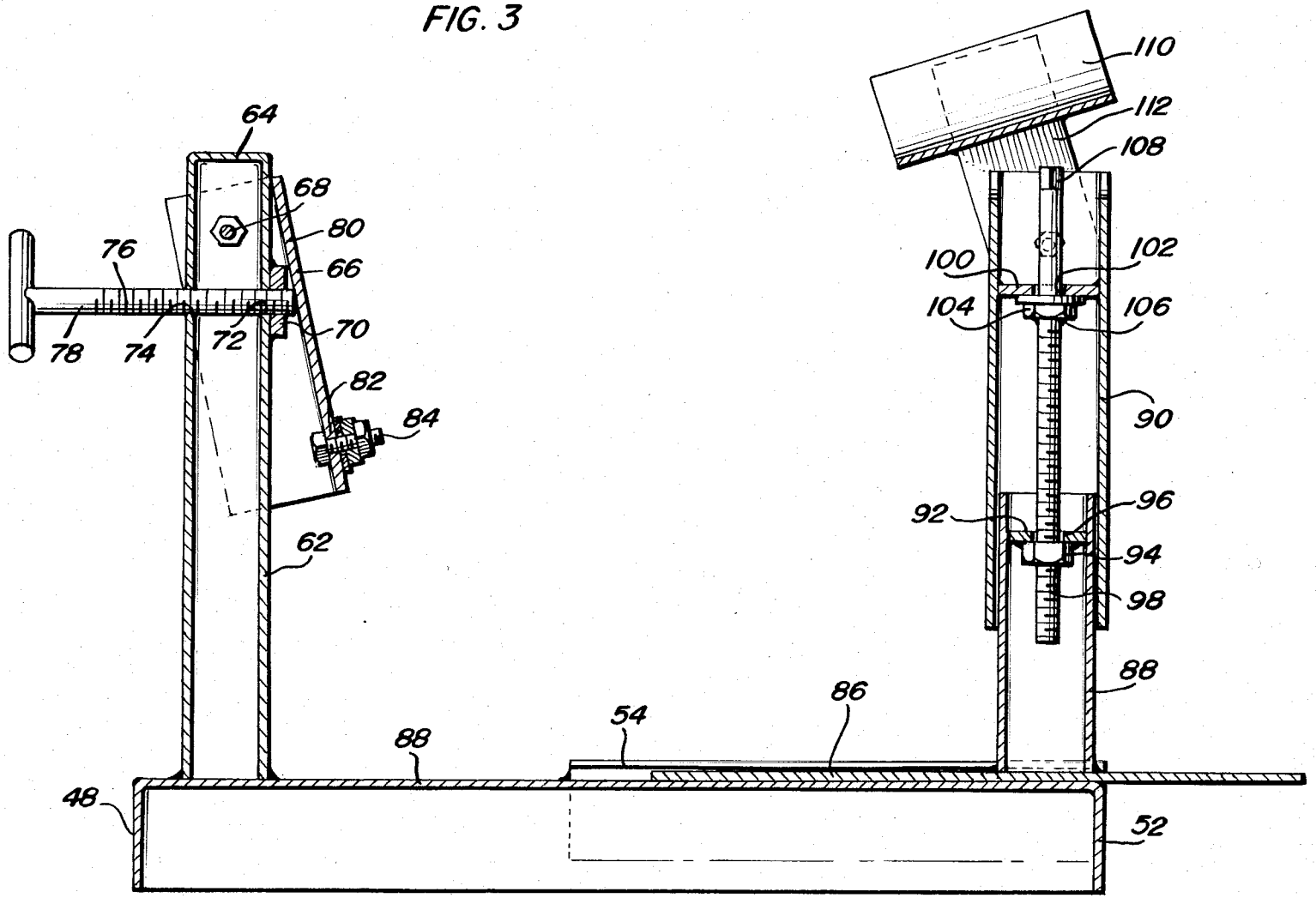
FIG. 3 is an enlarged vertical sectional view taken substantially upon the plane indicated by the section line 3—3 of FIG. 2.

Referring now more specifically to the drawings, the numeral 10 generally designates a conventional form of hydraulic press including a pair of laterally spaced apart channel-shaped uprights 12 and 14 interconnected at their lower ends by a lower base transverse channel member 16 and at their upper ends by an upper transverse channel member 18. A base plate or channel member 22 extends between the midportions of the channel members 12 and 14 and the side flanges of the channel members 12 and 14 are provided with vertically spaced apertures 24 through which pins 26 carried by the opposite ends of the base plate channel member 22 may be engaged to support the base plate channel member 22 at adjusted elevated positions between the channel members 12 and 14. The upper transverse channel member 18 supports an inverted hydraulic ram 28 and the ram 28 includes a downwardly extensible piston shaft 30.

A conventional McPherson-type strut assembly is generally designated as at 32 and includes a main strut portion 34 from whose lower end a knuckle 36 is supported. The knuckle 36 includes a mounting boss or tab 38 having a bore (not shown) formed therethrough and which may be disposed at various angles relative to the main strut portion 34. The knuckle 36 rotatably journals a wheel hub 40 and brake disc 42 therefrom by internal bearings (not shown) pressed into bearing seats (not shown). In order to remove the hub 40 and the disc 42, the bearings and hub 40 must be removed from the knuckle 36.

The jig of the instant invention is referred to in general by the reference numeral 46 and includes an inverted channel member 48 comprising a generally rectangular base. The opposite ends of the base are closed by end walls 50 and 52 as a means to rigidify the channel member 48 and a pair of angle members 54 and 56 are secured to opposite sides of the channel member 48 at one end thereof in order to form a pair of guide channels 58 and 60. The end of the base 48 remote from the angle members 54 and 56 mounts an upstanding tubular support 62 and the upper end of the support 62 is closed by a top wall 64 and oscillatably supports a channel-shaped mount 66 therefrom by a transverse pivot fastener 68 secured through the upper end of the support 62 and the channel-shaped 66. In addition, the upper end portion of the support 62 includes a nut 70 mounted on the exterior thereof at the side of the support which faces toward the angle members 54 and 56 and the wall of the support 62 from which the nut 70 is mounted includes a bore 72 formed therethrough while the remote side of the support 62 includes a second bore 74. The bores 72 and 74 are aligned with the threaded bore formed through the nut 70 and the threaded end 76 of a T-shaped adjusting screw 78 is passed through the bores 74 and 72 and threadedly engaged through the nut 70. The end of the adjusting screw 78 projecting through the nut 70 abuttingly engages the bight portion 80 of the U-shaped mount 66. Accordingly, the adjusting screw 78 may be adjusted in order to vary the inclination of the channel-shaped mount 66 relative to the support 62.

The lower end of the bight portion 80 has a bore 82 formed therethrough and a mounting shank 84 is removably secured through the bore 82 for a purpose to be hereinafter more fully set forth.

A support plate 86 is provided and slidingly supported on the upper bight portion 88 of the inverted channel member base 48 with the opposite side longitudinal edge portions of the plate 68 slidingly received in the guide channels 58 and 60. The support plate 68 mounts a second upstanding tubular support 88 therefrom including an upwardly extendible and downwardly retractable upper tubular end 90. A transverse partition 92 is secured within the upper portion of the support 88 and has a threaded nut 94 welded to the underside thereof. The partition 92 has a central bore 96 formed therethrough and the lower end of a threaded adjustment stud 98 passes through the bore 96 and is threadedly engaged through the nut 94. In addition, the upper terminal end 90 includes a partition 100 secured therein including a central bore 102 and a shouldered nut 104 is secured in position on the stud 98 by welding 106 and abuts the underside of the partition 100 with the upper end of the stud 98 projecting upwardly through the bore 102 and terminating in a non-circular upper terminal end 108 which may be engaged with a suitable tool in order to effect rotation of the stud 98 and thereby vertically adjust the upper terminal end 90 relative to the support 88.

The upper terminal end 90 supports an upwardly opening U-shaped cradle 110 therefrom. The cradle 110 includes opposite side depending legs 112 and 114 pivotally supported from opposite sides of the upper terminal end 90 through the utilization of pivot fasteners 116 and 118.

Accordingly, the support 88 may be shifted back and forth toward and away from the support 62 in the plane containing the supports 62 and 88, the channel-shaped mount 66 may be angularly adjusted relative to the support 62 and thus may be adjustably angularly displaced in the plane containing the supports 62 and 88. Further, the mounting stud 84 is angularly displaceable and swingable in the plane in which the supports 62 and 88 are disposed. Finally, the cradle 110 also is disposed and oscillatable in the plane containing the supports 62 and 88.

In operation, the base 48 is supported from the base plate 22 of the press 10 in generally the manner illustrated in FIG. 1 of the drawings. Thereafter, the mounting shank 84 may be secured through the bore formed in the boss or tab 38 and the strut portion 34 may be cradled in the cradle 110. Thereafter, the stud 98 and adjustment screw 78 may be adjusted until such time as the center axes of the bearing seats within the knuckle 36 are coaxial with the press ram. Thereafter, the press ram may be actuated in order to downwardly press the hub 40 and hub bearings (not shown) from the knuckle 36.

The importance of the jig 46 may be appreciated when it is understood that forces of more than several tons pressure may be required to press the hub 40 and its bearings from the knuckle 36. If the McPherson-type assembly 32 is not properly positioned relative to the ram of the press 10, such pressures can cause irreparable damage to the knuckle 36, hub 40 and hub bearings during a bearing removal operation.

It is to be noted that the jig 46 may also be used in connection with a horizontal mechanical or hydraulic ram merely by properly blocking the jig 46 in proper elevated position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a force member advanceable along a predetermined path and stationary base means toward which said force member is movable along said path, said base means including a pair of supports spaced apart on opposite sides of said path, one of said supports including a mount supported therefrom for angular displacement about an axis transverse to a plane containing said path and said supports, said mount including a mounting shank supported therefrom disposed and swingable in said plane during angular displacement of said mount about said axis, the other of said supports including cradle means supported therefrom for angular displacement about an axis transverse to said plane and laterally adjustable along a path substantially paralleling the first mentioned path, said cradle means being adapted to cradle the main strut portion of a McPherson strut assembly and said mounting shank being securable through a ball joint mounting bore formed in a mounting portion of the knuckle carried by one end of said main strut portion with said mounting shank and cradle means being adjustable about the first mentioned axis and along the second mentioned path, respectively, for positioning the knuckle of said strut assembly in position with the wheel of bearing seats of said knuckle aligned with the first mentioned path.

2. The combination of claim 1 wherein said force member comprises a ram of a press and said base means includes an abutment portion of said press toward and away from which said ram is advanceable along the first mentioned path.

3. The combination of claim 2 wherein said base means further includes a jig base abutted against said abutment portion and said supports are mounted from said base.

4. The combination of claim 3 wherein the first mentioned path comprises a substantially vertical path and said abutment portion is substantially horizontally disposed.

5. The combination of claim 1 wherein a first of said supports is mounted from said stationary base means for movement in said plane toward and away from the second support.

6. The combination of claim 5 wherein said first support mounts said cradle means.

7. The combination of claim 1 wherein the other of said supports comprises an elongated support member generally paralleling said path and having one end stationarily positioned relative to said base means, the other end of said elongated support member having a support sleeve telescopingly engaged thereover, said cradle means being oscillatably supported from the end of said support sleeve remote from said base means.

8. The combination of claim 7 wherein said base means and elongated support member include means for supporting said elongated support member from said base means for adjustable shifting toward an away from said one support.

9. A jig for positioning the hub journalling bearing seats of the knuckle of a McPherson-type strut assembly in substantial alignment with the path along which the ram of a press is movable toward and away from a workpiece supporting structure of the press, said jig including a base stationarily positionable on said workpiece supporting structure, a pair of elongated supports mounted from said base and projecting outwardly therefrom in parallel relation and disposed in the same plane, a mount supported from the outer end of one of said supports for infinite angular displacement, within a predetermined range, relative thereto about an axis disposed traverse to said plane, said mount supporting a mounting shank therefrom disposed and swinging in said plane during angular displacement of said mount relative to said one support, the other of said supports including cradle means supported therefrom for angular displacement about an axis transverse to said plane and shiftable along said other support.

10. The jig of claim 9 wherein said other elongated support is mounted from said base for adjustable shifting toward and away from said one support.

* * * * *